US008356869B2

(12) United States Patent
Knierim

(10) Patent No.: US 8,356,869 B2
(45) Date of Patent: Jan. 22, 2013

(54) BODY DIODE FORWARD CONDUCTION PREVENTION

(75) Inventor: David L. Knierim, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 139 days.

(21) Appl. No.: 12/823,618

(22) Filed: Jun. 25, 2010

(65) Prior Publication Data

US 2011/0316914 A1 Dec. 29, 2011

(51) Int. Cl.
*B41J 29/38* (2006.01)

(52) U.S. Cl. ..... 347/11

(58) Field of Classification Search ..... 347/9–11; 323/299

See application file for complete search history.

(56) References Cited

U.S. PATENT DOCUMENTS 5,502,468 A * 3/1996 Knierim ..... 347/19

* cited by examiner

*Primary Examiner* — An Do

(74) *Attorney, Agent, or Firm* — Marger Johnson & McCollom, PC

(57) ABSTRACT

A device has an output circuit arranged to receive a voltage pulse, a body diode associated with the output circuit, and a detection circuit electrically coupled to the voltage pulse and the output circuit, such that when the voltage pulse transitions from high to low, the detection circuit is configured to activate the output circuit to reduce current in the body diode. A circuit to control parasitic power dissipation in an integrated circuit has a P-channel FET having a source electrode coupled to a high voltage signal source and a drain electrode coupled to a load, a body diode associated with the P-channel FET, and a detection circuit. An apparatus has a print head arranged to dispense ink, a print driver circuit electrically coupled to the print head and configured to provide voltage pulses to actuate the ejection ports through an output circuit, and a detection circuit electrically coupled to the output circuit.

13 Claims, 6 Drawing Sheets

BODY DIODE FORWARD CONDUCTION PREVENTION

BACKGROUND

Solid ink jet printers generally have print head driver or controller chips that control the voltages sent to the actuators. The actuators convert the voltages received into mechanical energy that pushes ink drops out of apertures (or "jets") to form images on a print surface. Control of the actuators controls the sizes of the drops and the velocity at which they exit the apertures.

Manufacturing variances can affect both the size and the velocity of ink drops. Typically, print heads undergo testing after manufacture to determine the nature and magnitude of the variances. A process referred to as "normalization" adjusts the voltage applied to each actuator corresponding to each jet to cause the jet to expel ink drops of a standard size and at a standard velocity within some tolerance range. Typically, the normalization process employs at least one transistor as part of the driver chip circuitry, typically on the outputs.

Within the semiconductor layers used to form the transistors "body diodes" generally form. The "body diodes" consists of PN junctions between the source/channel and drain regions of the transistors, typically field-effect transistor (FETs), such as in MOSFETs (metal oxide semiconductor FETs). The body diodes form base and emitter terminals of parasitic, bi-polar junction transistors. The collector terminals of these bi-polar junction transistors may be the chip substrate.

The body diodes conduct current during the trailing edges of high-voltage pulses used in the actuation circuitry. This current causes parasitic current to the chip substrate, creating unwanted power dissipation within the chip. Newer trench-isolated silicon chip processes, while advantageous for print head driver chip fabrication, have even higher gain in these parasitic bi-polar transistors, resulting in higher parasitic current flowing to the chip substrate.

DETAILED DESCRIPTION OF THE EMBODIMENTS

Figure 1:
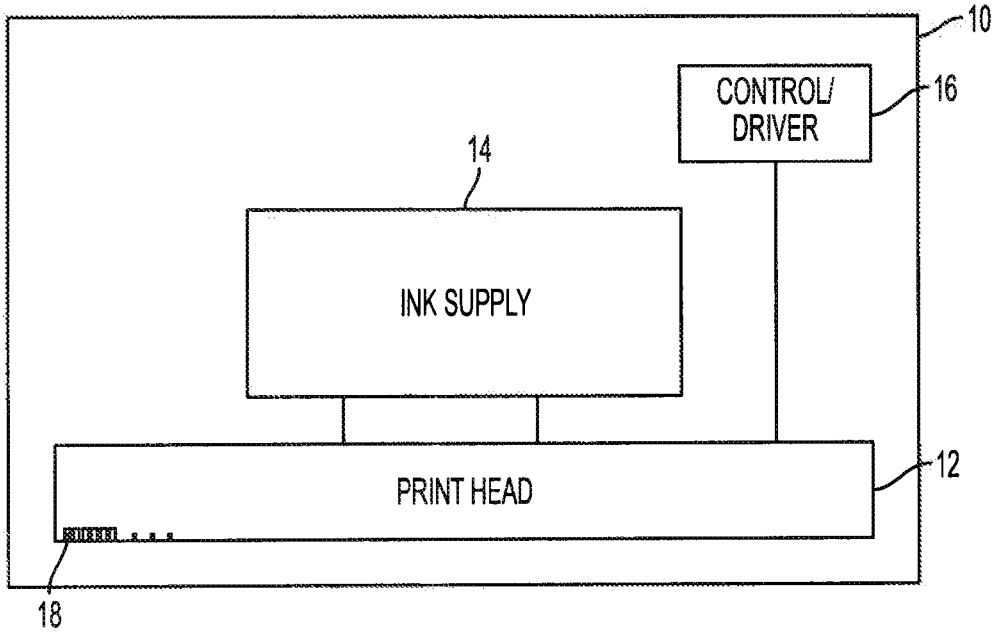
FIG. 1 shows a block diagram of a print system.

FIG. 1 shows a simplified block diagram of a printing system. Printing system 10 may consist of a printer, a fax, a multi-function peripheral (printer/scanner/copier/fax or any combination of those), or any other device that transfers ink to a print surface such as paper. It must be noted that the discussion of the circuitry and drivers here focuses on printers, and specifically ink jet printers, but that the circuitry may apply to any device that has a high voltage output circuit in which a body diode may exist and conduct substantial current.

An ink jet printer generally consists of an array of ejection ports such as 18, also referred to as nozzles or jets, each of which expel ink in accordance with a signal from the controller/driver such as 16. The print head generally draws its ink from an ink supply such as 14, which may consist of liquid ink, or of solid ink that melts and becomes liquid.

A control module, which may take the form of a single integrated circuit 'chip,' or may consist of several chips, determines which jets will expel ink at what intervals by sending signals to actuators associated with the jets. The data used to send those signals comes from image data, either sent to the printer electronically, such as through fax or from a computing device, or from image acquisition by scanning, such as making copies. The signals typically consist of voltage pulses sent to the actuators in the print head.

The transducers convert the electrical signals into some form of mechanical force that cause the jets to expel ink. In some ink jets, the transducers consist of resistors that become hot when they receive the voltage, causing bubbles to form around them. The expansion of the bubbles forces ink out of the jets. In another example, the transducers consist of piezoelectric elements that compress ink within body chambers, causing ink to exit the jets.

Since a typical print head has hundreds or thousands of jets, each with their own transducer, the print heads consume relatively high amount of power. Inefficiencies in the system that result in loss of power in turn result in a lower efficiency, higher cost print system. One such inefficiency lies in body diodes in the output transistors. Each jet receives an output signal from a driver circuit in which a transistor controls the transmission of the output signal. Each transistor has a body diode that dissipates power.

A body diode results from a by product of the semiconductor manufacturing process used to manufacture the output circuit for the voltage signal that activates the transducers. Typically, a body diode acts a bi-polar junction transistor with the base and emitter terminals formed by the PN junction and the collector being the chip substrate. These body diodes become forward biased, conducting current essentially into the chip substrate, causing the chip substrate to absorb power. This essentially 'wastes' the power, making the device inefficient.

In the below discussion, the output circuit 22 takes the form of a P-channel field effect transistor (PFET), but no limitation is intended to this structure nor should any be implied. The drive circuitry may be implemented in the opposite logic, resulting in a NFET being the output circuit, etc. Other types of transistors may also have similar effects to the body diode.

Figure 2:
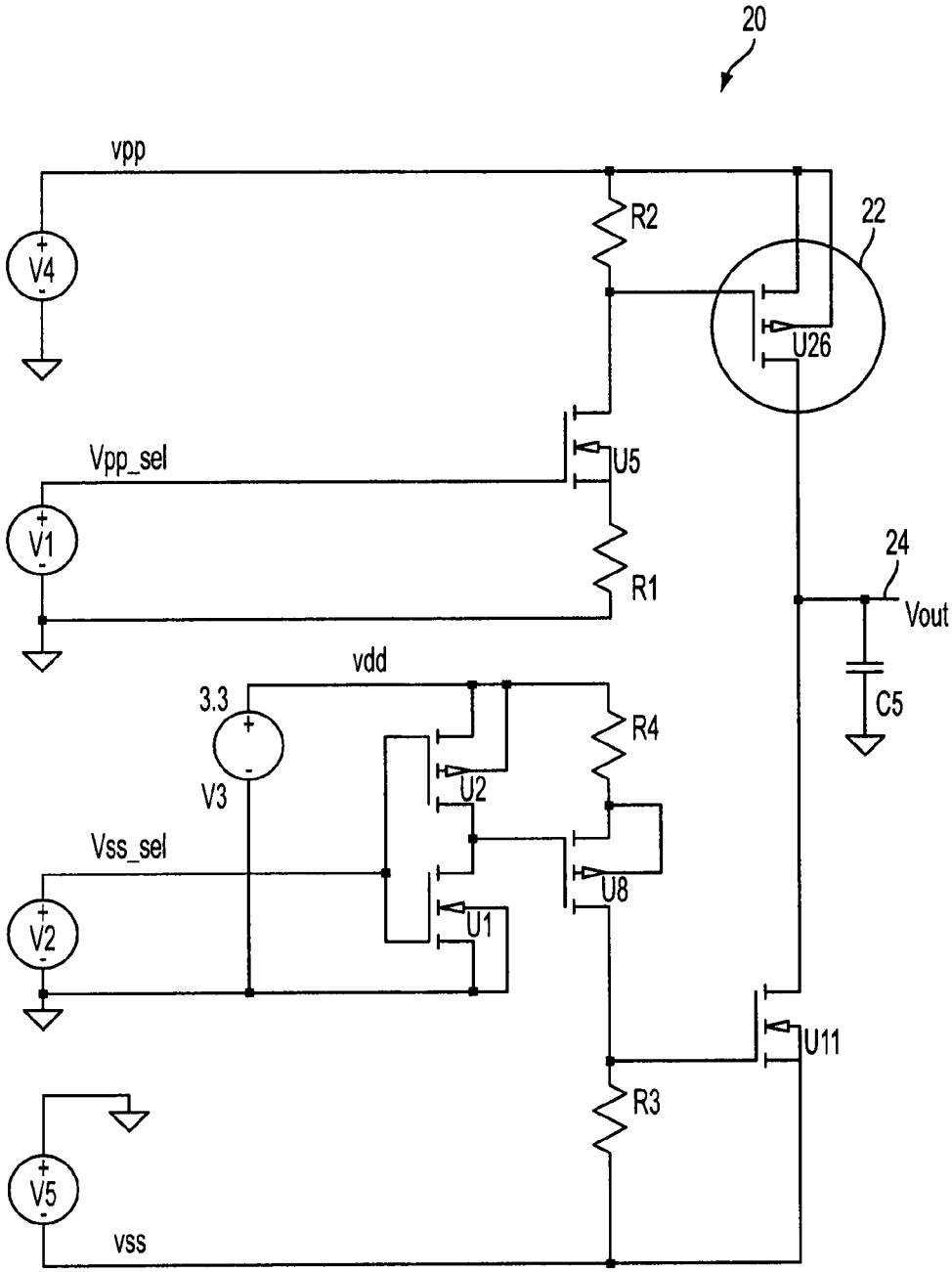
FIG. 2 shows simplified diagram of one output of a print system driver chip.

FIG. 2 shows a simplified, conceptual diagram of a driver circuit 20 intended to assist in understanding of the embodiments. VPP (V4) and VSS (V5) are the high-voltage supply rails providing power as pulsed input, with VPP being the positive high-voltage supply and VSS being the negative high-voltage supply. One should note that the term 'high-voltage' as used here means any voltage level that is above the voltage level supplied to the logic circuitry. In this diagram, the low-voltage logic supply is Vdd (V3). In one embodiment, the low-voltage 'high' logic output is 2.5 V and the high-voltage output is 50V.

The signals Vpp_sel (V1) and Vss_sel (V2) are the low-voltage digital inputs to the logic circuitry. Vout is the high-voltage output to the print head element, the ejection port, nozzle or jet. For purposes of this circuit, a capacitor C5 simulates the jet load. The PFET U26 and NFET U11 form the output circuit.

During the rising edges of the pulses from VPP, the high-side output circuit 22, turns off at the appropriate time to leave the desired positive voltage level on Vout. During the subsequent falling edge of the VPP pulse, the body diode associated with the PFET becomes active and begins to conduct current. This causes the voltage at the jet, Vout, to return to 0 V.

Typically, designers rely on the body diode becoming forward biased and conducting current since that pulls the voltage to 0. However, controlling the amount of current it conducts becomes important to reduce the parasitic power dissipation. If the body diode conducts too much current it will waste power By turning the high-side output circuit 22 back on, the amount of current the body diode conducts becomes reduced, alleviating the parasitic power dissipation. Generally, the output circuit should remain in the on state, regardless of the drop in the current conducted by the body diode. Otherwise, the current may drop sufficiently to turn the output circuit off, initiating an oscillation in the circuit.

Figure 3:
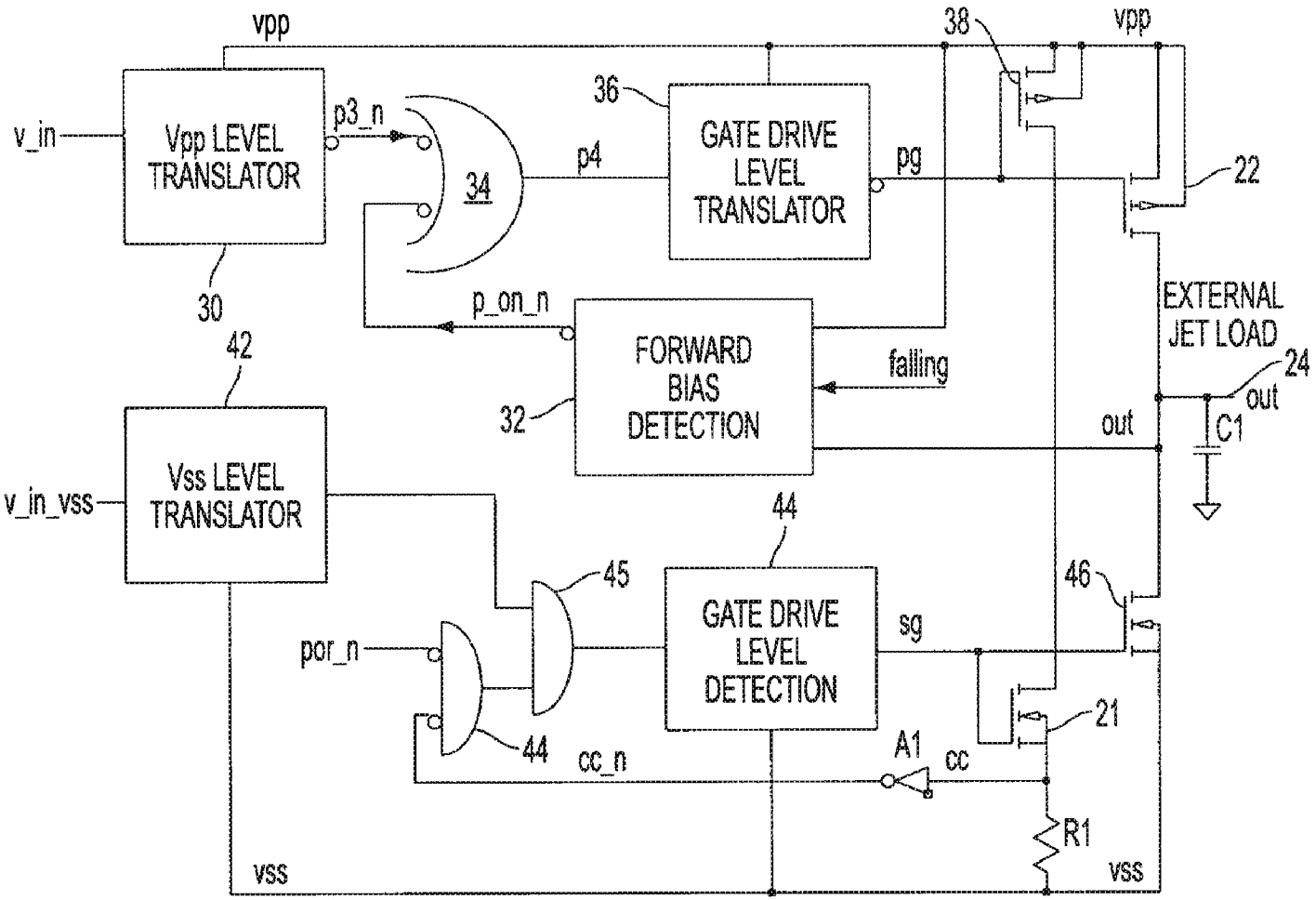
FIG. 3 shows an embodiment of one output of a print system driver circuit.

Having seen a more simplified version to assist in understanding the embodiments, the discussion now turns to a more detailed diagram shown in FIG. 3 of the driver circuit. FIG. 3 has high-side circuitry associated with the high-side voltage VPP and low-side circuitry associated with the low-side voltage VSS. This discussion will focus on the high-side circuitry associated with VPP at the top of the figure, but demonstrates embodiments of the low-side circuitry for completeness.

In the embodiment of FIG. 3, a Vpp voltage level translator 30 generates a signal referred to here as p3_n. The Vpp voltage level translator translates the ground-referenced input voltage V_in to a voltage usable to drive the logic circuitry referenced to Vpp. The output of this translator is signal p3_n. When p3_n is low (2.5V below Vpp, for example), it turns on the output circuit/PFET 22, when p3_n goes high (same voltage as Vpp, for example), the PFET 22 turns off. When p3_n is high, the signal p_on_n goes low to turn on the output PFET 22 during the falling edge of the Vpp pulses, but only after the body diode in PFET 22 becomes forward biased.

The forward bias detection circuit 32 detects when the body diode in PFET 22 becomes forward biased, which will be discussed in more detail with regard to FIG. 4. The forward bias detection circuit 32 generates the signal p_on_n in response to this forward biasing of the body diode and is enabled by the signal falling that results from the falling edge of the Vpp pulse. FIG. 5 shows an embodiment of a circuit to generate the falling signal and will be discussed later.

The logic gate 34 generates a signal p4 when the p_on_n and p3_n signals are both low. One should note that the gate shown here is an OR gate with inverted inputs (NAND gate), but could be implemented in many other ways. The signal p4 will generally be a 'logic level' signal, where the driving voltage for the PFET needs to be considerably higher. The gate drive level translator 36 translates the logic high signal to an appropriate voltage to drive the gate of the PFET 22 as signal pg, for example, 9V below Vpp. This signal will cause the PFET to turn ON. The p_on_n signal will remain low (true) until the signal falling goes low (false). This avoids oscillation. When the PFET 22 turns on, it conducts current, reducing the body diode current and in turn reducing the parasitic current to the chip substrate.

Figure 4:
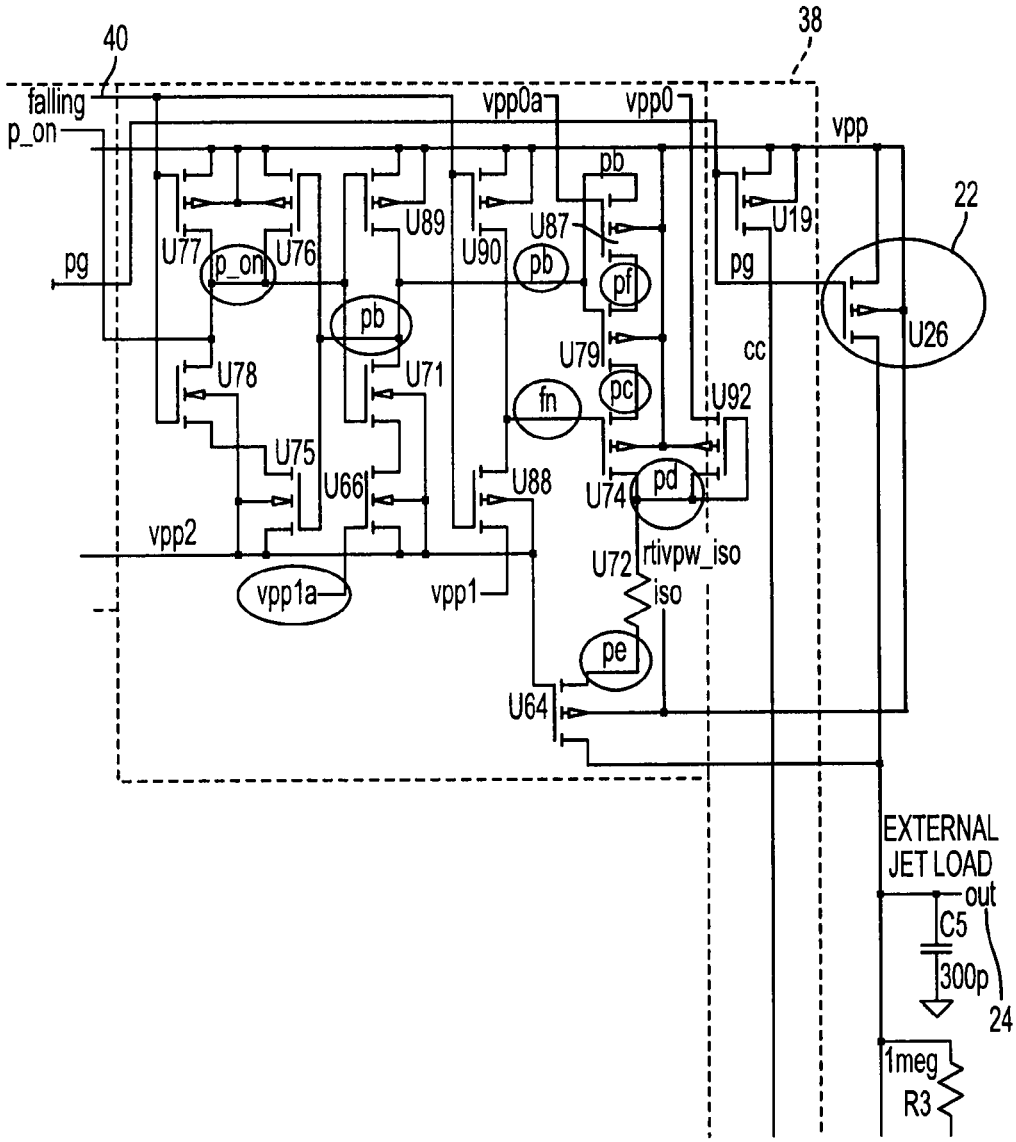
FIG. 4 shows a more detailed embodiment of a detection circuit used in a printer driver circuit.
Figure 5A:
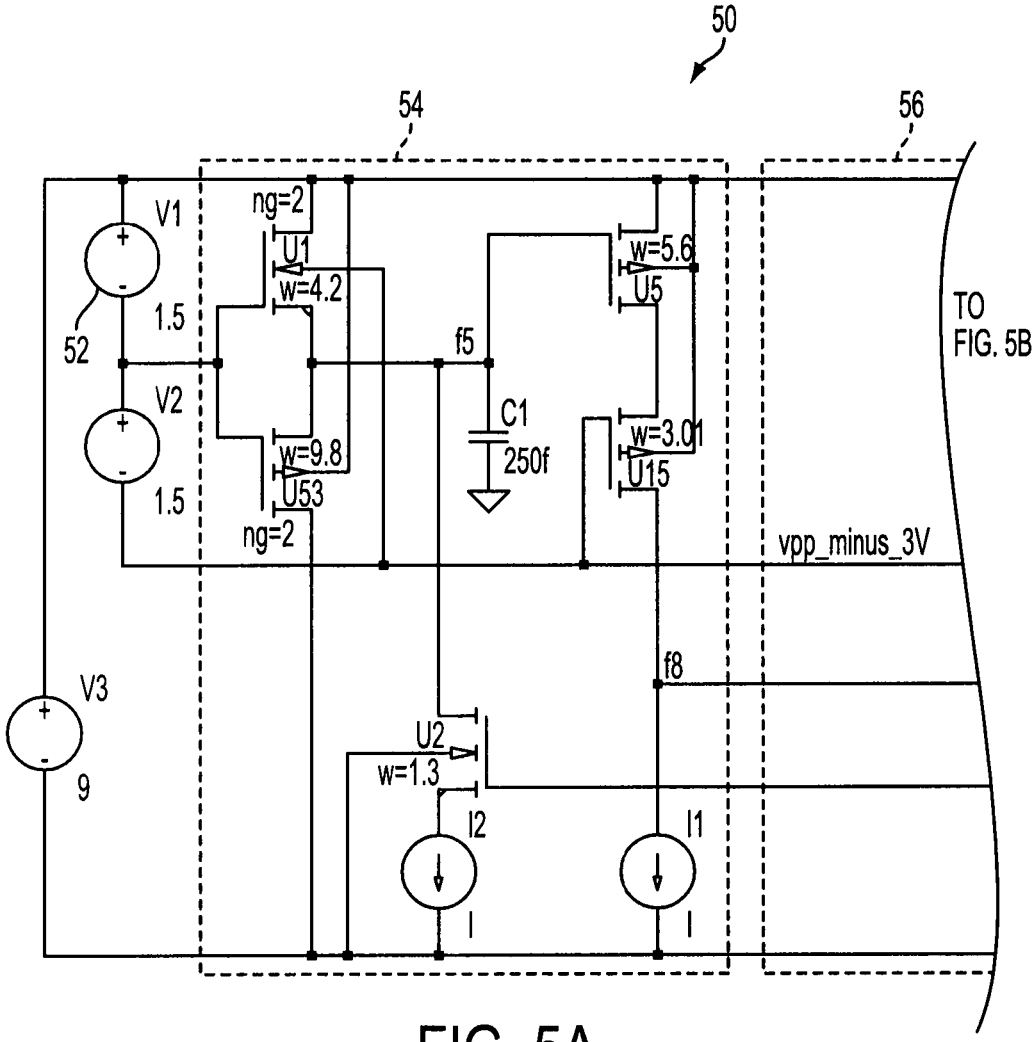
FIG. 5 shows an embodiment of a circuit used to generate a falling signal used in a print system driver circuit.
Figure 5B:
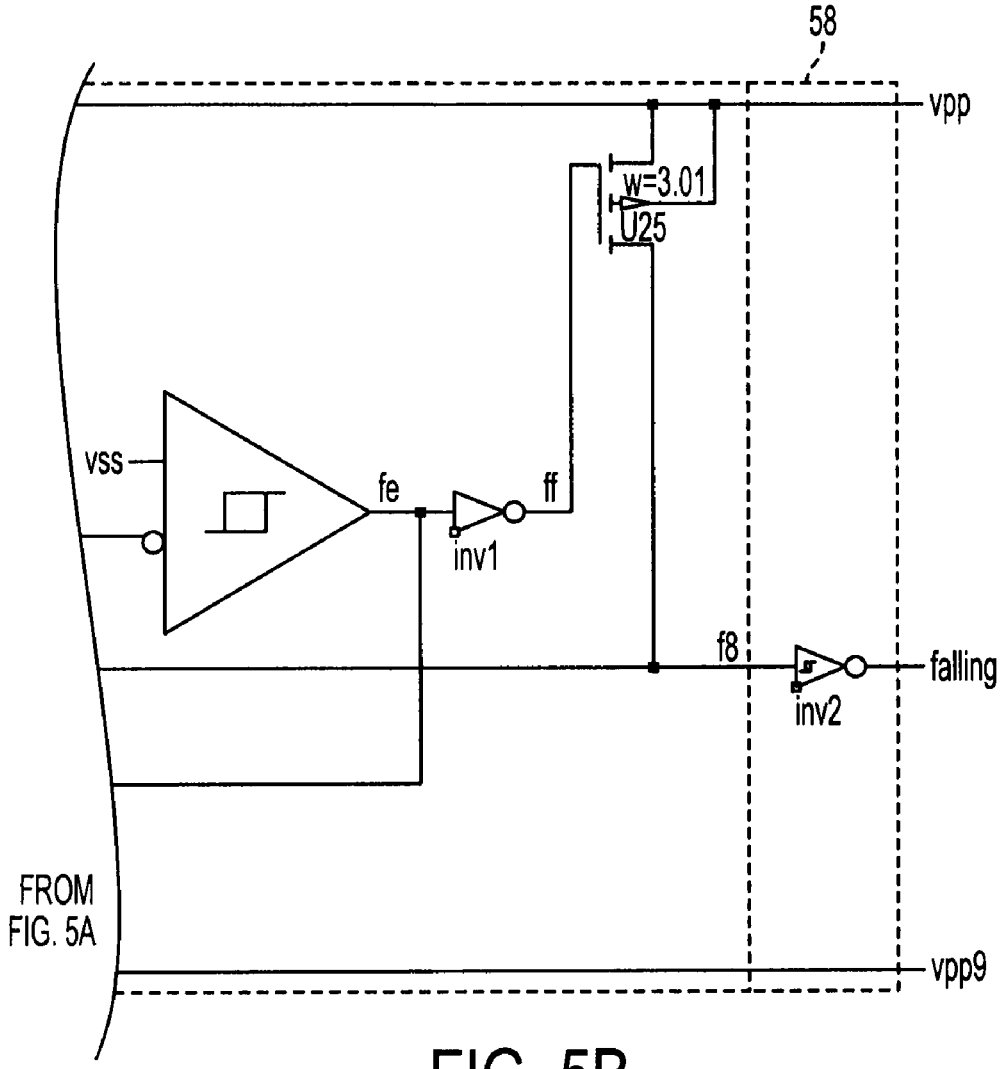

FIG. 4 shows a more detailed view of the forward bias detection circuit 32. As mentioned above, the signal falling enables the detection circuit. When falling goes high or true, Vpp has a falling edge. When Vpp drops below the output (drain) voltage of the PFET 22 in FIG. 4, nodes pe and pd will be slightly above Vpp. If the signal falling is also true, node fn will be low and node pf will rise above Vpp.

The bias voltage vpp0*a*, on the gate of PFET U87, is held constant at approximately one PFET threshold voltage below Vpp. Therefore, when node pf on the drain of U87 rises above Vpp, the node pb will be pulled up. When node pb overcomes the pull down current of the NFET U66, node pb goes high. This pulls node p_on_n low, turning on the output PFET 22. The NAND gate of U77/U78 and U76/U75 for p_on_n and pb are cross-coupled through inverter U71/U89 to keep p_on_n low until the enabling signal falling goes low (false).

This cross-coupled gate/inverter pair acts as a latch to stabilize the state of the output PFET 22 as ON. Otherwise, the act of turning on the PFET 22 may reduce the body diode current sufficiently to cause the PFET to turn OFF. Once the PFET turns OFF, the body diode being forward biased may cause it to turn back ON, initiating an oscillating sequence.

In summary, the circuit turns on the high-side VPP output circuit when the associated body diode becomes, or is about to become, forward biased. The forward biasing occurs when the voltage on the output of the output circuit, in this case the drain of PFET 22, rises above the VPP supply voltage on the source of the PFET 22. The output circuit only turns on again during the falling edges of VPP, avoiding un-intentional turn-on events due to offset voltages or small noise signals on VPP or the jet output. The circuit also avoids oscillation due to the reduction in body-diode current once the output circuit turns on again.

As mentioned above, the signal falling enables the detection circuit 38 of FIGS. 3 and 4. FIG. 5 shows one embodiment of a circuit 50 to generate such a signal. One skilled in the art may note that many different types of circuits can generate the falling signal, of which the circuit 50 is an example. In general, the circuit 50 includes bias voltage sources, such as 52, a detection circuit 54 that detects the falling edge of Vpp, and a disabling circuit 56 that disables the falling signal as Vpp approaches the negative high-voltage rail Vss.

The signal falling must be true during the falling edges of VPP pulses, detected by the detection circuit 54. The detection circuit 54 in this embodiment causes the signal to go true on the falling edge of the VPP pulse. The circuit detects the falling edges when Vpp has dropped by some predetermined margin, such as −1 or −2 volts, and that drop lasts for at least some predetermined minimum time, such as 30 nanoseconds. This voltage margin and minimum time prevent unintended triggering of signal falling due to momentary spikes or overshoot on Vpp.

The disabling circuit 56 acts to disable the falling signal when the level of VPP nears that of Vss. In this example, the falling signal is disabled when VPP reaches 3 V above Vss. This ensures that the output PFET 22 is OFF before the output NFET 46 turns ON, in the circuit of FIG. 3. The state where both the PFET and the NFET are on is referred to as 'cross-conduction', a state that must be avoided to prevent circuit damage.

Returning momentarily to FIG. 3, one can see that the pg signal that turns on the output drive PFET 22 also turns on a smaller PFET 38. PFET 38, along with NFET 21, resistor R1, and inverter A1, generate a signal cc_n, which is true (low) in the event that cross-conduction does occur. Cross-conduction would occur if both of PFET 22 and the NFET 46 were ON at the same time. The gate 44 receives the cross-conduction signal as one input and a low-true power-on reset signal por_n as the other. This ensures that the NFET 46 does not turn ON at the same time the PFET 22 is ON. The power-on reset signal also ensures that the NFET is OFF when the circuit is initially powered on, also avoiding cross-conduction.

In FIG. 5, the output of the disabling circuit is the signal fe when Vpp has a value some safety margin above Vss. In one embodiment, the disabling circuit 56 disables the falling signal when Vpp is within 3 volts of Vss. The actual margin provided will depend upon the operating voltages of the actual circuit implementation. A buffer 58, which may be a Schmitt trigger output buffer as an example, provides for the stability of the output signal falling.

The example of FIG. 5 provides merely one embodiment of a signal generating circuit that produces a signal when the Vpp pulse has a falling edge. Many other implementations of such a circuit are possible. Any such circuit that generates such a signal reliably and avoids cross-conduction is within the scope of the embodiments here.

In this manner, forward biasing of the body diode on the output PFET is detected. The detection then causes the output PFET to turn ON to reduce the body diode current and reduce parasitic current to the chip substrate, reducing the wasted power. The detection is enabled and disabled by a global signal falling, and the state of the detection is latched to prevent oscillation.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A device, comprising:

an output circuit arranged to receive a voltage pulse;

a body diode associated formed within transistors of the output circuit; and a detection circuit electrically coupled to the voltage pulse and the output circuit the detection circuit electrically coupled to the output circuit to detect when the body diode conducts current and to activate the output circuit to reduce current in the body diode.

2. The device of claim 1, further comprising a level translator to translator a low-voltage logic signal into the high-side logic signal.

3. The device of claim 1, further comprising a signal generator configured to generate a signal upon the transition of the voltage pulse from high to low.

4. The device of claim 1, further comprising a latch electrically coupled to the output circuit and configured to maintain activation of the output circuit until the voltage pulse transition is complete.

5. The device of claim 4, wherein the latch comprises a cross-coupled inverter/gate pair.

6. The device of claim 1, wherein the output circuit comprises a field-effect transistor.

7. A circuit to control parasitic power dissipation in an integrated circuit, comprising:

a P-channel FET having a source electrode coupled to a high voltage signal source and a drain electrode coupled to a load;

a body diode associated formed within the regions of the P-channel FET such that the body diode conducts current on a falling edge of a high voltage pulse from the high voltage signal source; and a detection circuit electrically coupled to the P-channel FET arranged to detect when the body diode conducts current and to cause the P-channel FET to turn on so as to reduce the current and lower parasitic power dissipation caused by the body diode conducting current.

8. The circuit of claim 7, wherein the P-channel FET is electrically coupled to the high voltage signal source such that the P-channel FET turns off during a rising edge of the high voltage pulse.

9. The circuit of claim 7, wherein the P-channel FET is electrically coupled to a signal that becomes true at the falling edge of the high voltage pulse.

10. The circuit of claim 9, wherein the P-channel FET is electrically coupled to a cross-coupled inverter gates such that the P-channel FET stays in the on state until the signal becomes false.

11. The circuit of claim 7, wherein the drain electrode is electrically coupled to a cross-coupled inverter gate pair configured to keep the P-channel FET on until the signal goes false.

12. An apparatus, comprising:

a print head arranged to dispense ink onto a print surface through an array of ejection ports;

a print driver circuit electrically coupled to the print head and configured to provide voltage pulses to actuate the ejection ports through an output circuit;

a detection circuit electrically coupled to the output circuit and arranged to receive a signal from the print driver circuit when a body diode formed within transistors of the output circuit becomes forward biased, and to send a signal to the output circuit to turn the output circuit on.

13. The apparatus of claim 12, further comprising:

a P-channel FET having a source electrode coupled to the print driver circuit and a drain electrode coupled to a load; and the body diode arranged such that the body diode conducts current on a falling edge of a high voltage pulse from the print driver circuit.

* * * * *